US005369832A

United States Patent [19]

Hagger

[11] Patent Number: 5,369,832

[45] Date of Patent: Dec. 6, 1994

[54] BUCKET MOUNTED SWEEPER

[76] Inventor: Anthony R. Hagger, 1212 McPhail Rd., Bel Air, Md. 21015

[21] Appl. No.: 103,865

[22] Filed: Aug. 9, 1993

[51] Int. Cl.[5] ..... E01H 1/04

[52] U.S. Cl. ..... 15/83; 15/82

[58] Field of Search ..... 15/79.1, 82, 83, 84; 414/697; 37/244, 304, 419

[56] References Cited

U.S. PATENT DOCUMENTS

| | | | |
|---|---|---|---|
| 2,189,859 | 2/1940 | Evans | 15/85 |
| 2,684,496 | 7/1954 | Lull | 15/83 |
| 2,697,846 | 12/1954 | Wilcox et al. | 15/83 |
| 2,708,280 | 5/1955 | Antos et al. | 15/83 |
| 2,709,269 | 5/1955 | Williams | 15/50 |
| 3,114,923 | 12/1963 | Jones | 15/82 |
| 3,337,890 | 8/1967 | Schmidt, Jr. | 15/83 |
| 3,444,583 | 5/1969 | Laurel | 15/340 |
| 3,568,232 | 3/1971 | Swanson | 15/83 |
| 3,878,952 | 4/1975 | Hueftle | 414/697 |
| 4,895,476 | 1/1990 | Vangaever | 15/83 |

FOREIGN PATENT DOCUMENTS

| | | | |
|---|---|---|---|
| 1283362 | 7/1972 | United Kingdom | 15/82 |
| 8604626 | 8/1986 | WIPO | 15/83 |

*Primary Examiner*—Edward L. Roberts

[57] ABSTRACT

A mounting and stand system for a bucket brush sweeper that will allow the sweeper to be easily attached or removed from a bucket assembly. After the sweeper is detached from the bucket the brush may then stand alone on stands to allow the bucket to be used alone in a normal fashion unrestricted by the sweeper. The brush may later be easily reattached to the bucket and the stands may be stored for sweeping operations.

3 Claims, 6 Drawing Sheets

BUCKET MOUNTED SWEEPER

BACKGROUND OF THE INVENTION

Various arrangements have long been in use involving the provision of a rotary member, such as a brush, at the front end of road cleaning machines, and the desirable features of such brushes are well recognized. However attempts to utilize a brush or other rotor element at the front end of a machine with a bucket, such as a front end loader, have not been successful owing to the difficulty arising from the complexity of the attachment of the brush to the bucket and time required to accomplish this fixing.

Known brushing apparatus and methods are described in U.S. Pat. Nos. 2,697,846 to Wilcox et al and 4,895,476 to Vangaever. The bucket and brush assembly described by Wilcox does not provide for quick detachment of the bucket from the loader arms. While Vangaever describes a quick release mounting between the bucket and the loader arms, no quick release method is defined between the bucket and the brush assembly. Either of these approaches do allow a loader to be used as a sweeper but neither allows the loader to convert easily from one mode to the other. The attachment between the bucket and the brush must be quick and simple to allow the vehicle to convert from a conventional bucket configuration to a sweeper and back again, allowing the practical use of both functions by one vehicle.

SUMMARY OF THE INVENTION

The present invention relates to an improvement in materials handling machines of the type that includes a bucket supported at the front end by hydraulically operated boom arms or similar mechanism. Machines of this type include devices such as front end loaders, skid steer loaders, rough terrain forklifts, tractor loader backhoes or any similar motor vehicle with a bucket mounted at the end of a boom.

This invention aims to devise a brush attachment that can be readily attached to one of these machines without interference with the normal working of the bucket and the bucket mechanism. The present invention allows a standard bucket means to be used to collect the bulk material and a brush means capable of freely standing on support legs that may be quickly attached to the bucket to collect the small debris not collected by the bucket operation. Another object is to have the brush support legs be self storing on the brush assembly.

One preferred application relates to recent developments in highway resurfacing equipment that includes the use of planers to remove the surface of the highway by grinding the surface to a specified depth in preparation for a new surface to be applied. This application requires that the ground materials spilled onto a road surface while being transferred to the grinding collection means from the grinding means be collected. The old highway surface that was planned must be swept clean of all debris for the new surface to adhere to the highway. This invention allows a convenient means of quickly converting between a bucket and a brush to accomplish this cleaning operation.

These and other objects and novel features will be more fully understood and appreciated from the following description of a preferred embodiment of the invention selected for purposes of illustration and shown in the accompanying drawings, in which:

Figure 1:
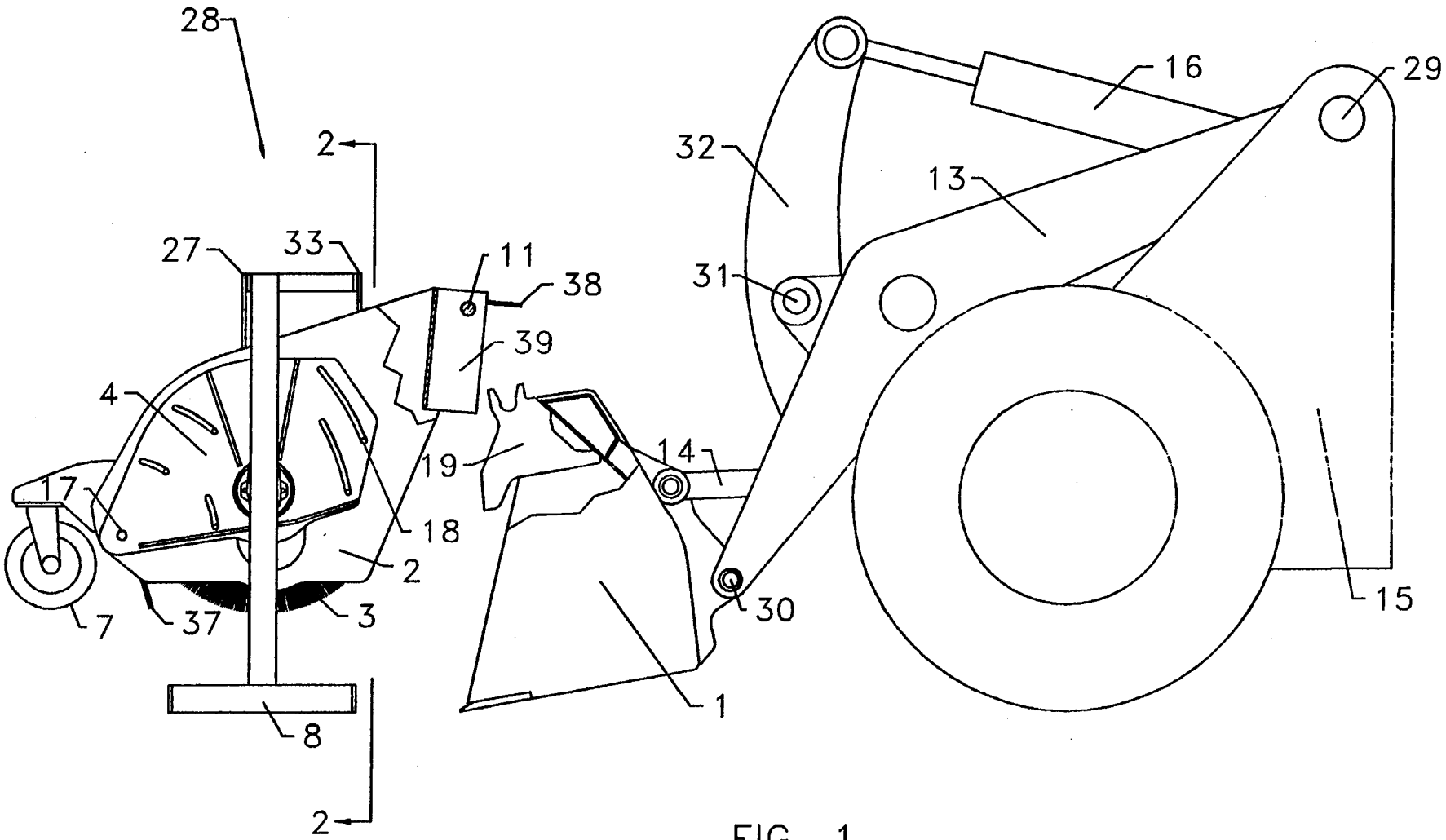
FIG. 1 is a fragmentary side view of the front portion of a loader and illustrating the brushing apparatus, according to the invention, mounted on the stands in position for attachment to the loader bucket.

| No. | Description |
|---|---|
| 1 | bucket assembly |
| 2 | brush container |
| 3 | brush wafer |
| 4 | motor adjustment plate |
| 5 | drive motor |
| 6 | bearing adjustment plate |
| 7 | height control wheel |
| 8 | left stand leg |
| 9 | right stand leg |
| 11 | brush assembly mounting pin |
| 12 | mounting pin lock |
| 13 | loader arm |
| 14 | connecting link |
| 15 | loader front section |
| 16 | bucket actuation cylinder |
| 17 | brush mounting plate pivot pin |
| 18 | brush mounting plate adjustment bolts |
| 19 | brush mount bucket hook |
| 20 | brush wafer carrier assembly |
| 21 | stand pivot pin |
| 22 | lowered position stand lock |
| 23 | brush support bearing |
| 24 | brush drive coupling |
| 27 | front leg stand mounting plate |
| 28 | power operated brush assembly |
| 29 | loader arm pivot connection |
| 30 | bucket pivot pin |
| 31 | bucket tipping lever pivot pin |
| 32 | bucket tipping lever |
| 33 | rear leg stand mounting plate |
| 34 | brush wafer carrier assembly trunnion |
| 35 | upper left stand lock |
| 36 | upper right stand lock |
| 37 | lower dust seal |
| 38 | upper dust seal |
| 39 | brush assembly mounting support |
| 40 | arm lift cylinder |

DETAILED DESCRIPTION OF THE INVENTION

In the structure shown in the drawings, numeral 15 denotes loader front section that is intended to be illustrative of various types of machines, as noted above, with which the invention may be employed. It is customary on these loaders for the engine to be located in the rear portion of the vehicle and this rear portion has not been shown in the drawings as it forms no part of the present invention.

Numeral 13 denotes the customary loader arms that are employed in loaders to support a bucket assembly 1. The loader arms occur in pairs and are pivotally supported on two opposite sides of the loader body at loader arm pivot connection points 29. Pairs of hydraulic arm lift cylinders 40 are pivotally mounted on the loader front section 15 and are connected to the loader arms 13 and when operated function to raise and lower the loader arms 13 carrying the bucket assembly 1 into any desired position. The hydraulic cylinders are usually driven by pumps located, for example, in the rear of the vehicle and directly geared to the motor shaft of the vehicle engine, there being regulating valves in the loader cab for controlling the lifting operation.

The brushing apparatus according to the invention further comprises a power operated brush assembly generally referred to as reference 28 and a bucket assembly 1 for collection of the brushed material. According to the invention, the brushing apparatus is connected to the loader arms through bucket assembly 1 and is swingable or pivotal relative thereto about the bucket pivot pin 30 axis under the action of bucket actuation cylinder 16 controlled from the loader.

Figure 3:
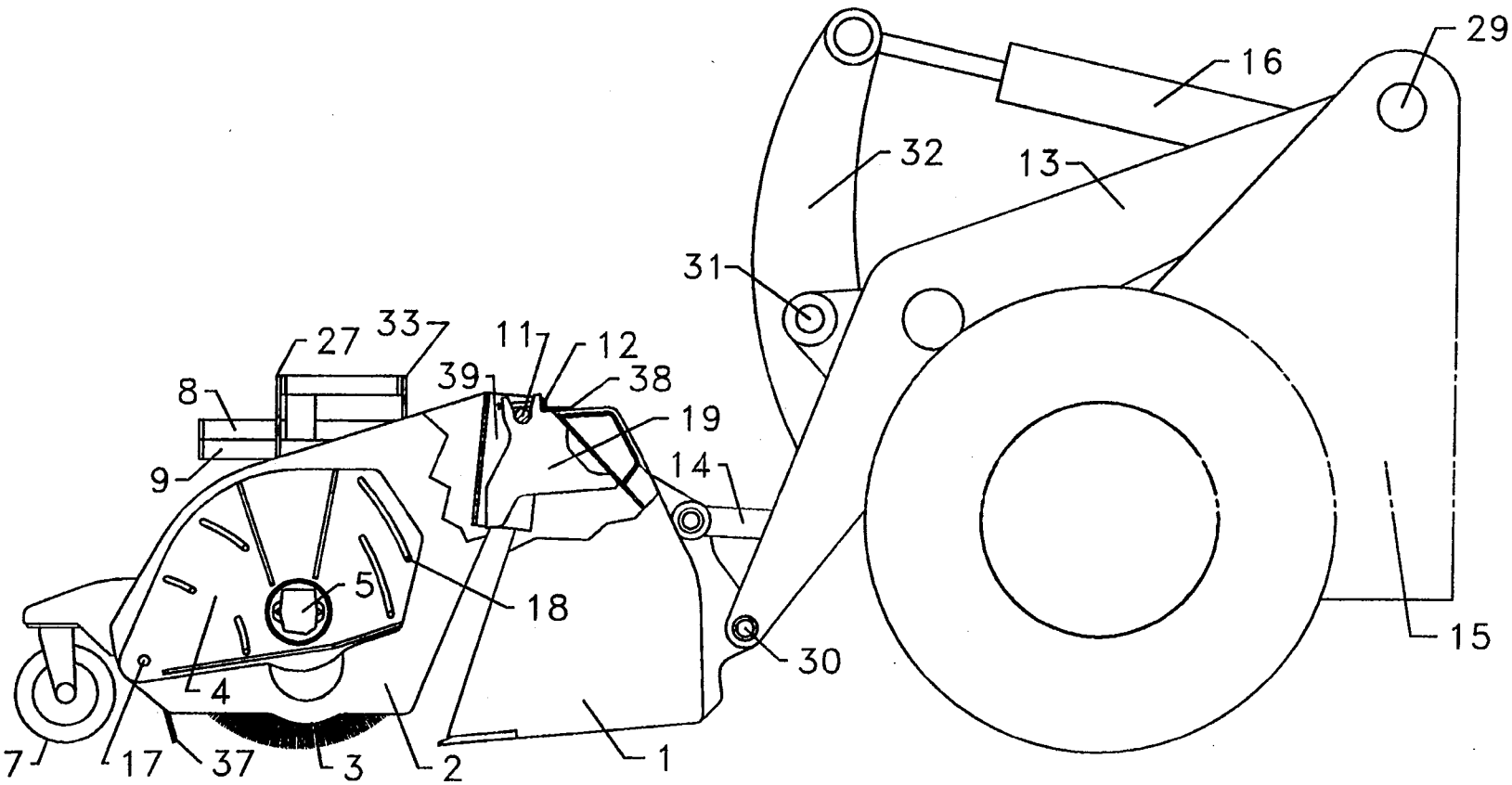
FIG. 3 shows a side view of the brushing apparatus in operating position.

In the embodiment as shown in FIG. 3, the brush mount bucket hooks 19 are joined to the bucket assembly 1 or are formed integral with bucket assembly 1 and extend above the bucket assembly 1. Bucket assembly 1 is moved into position by raising loader arms 13 with arm lift cylinders 40 and bucket assembly 1 is tipped by bucket actuation cylinder 16 through connecting link 14 into brush assembly mounting support 39 to connect to brush assembly mounting pin 11.

In the embodiment shown in FIG. 3 cutaway view, bucket assembly 1 is provided along each upper front corner thereof with brush mount bucket hooks 19 which project above the upper edge of the bucket.

In the embodiment as shown in FIG. 1 the power operated brush assembly 28 is easily disconnectably or demountably connected to the bucket assembly 1 by means of the fast-locking brush mount bucket hooks 19 that lie approximately at the top front edges of bucket assembly 1 and is rotatable about brush assembly mounting pin 11 axis and held in place with mounting pin locks 12. The easily disconnectable connections between the fast-locking brush mount bucket hooks 19 and brush assembly mounting pins 11 may be in any known connection such as hooks and pins.

Motor adjustment plate 4 and bearing adjustment plate 6 for mounting the brush wafer carrier assembly 20 are carried at one of their ends by being pivotally fixed to horizontal brush mounting plate pivot pins 17. Motor adjustment plate 4 and bearing adjustment plate 6 are in planar alignment with brush container 2 side plates and the side plates of bucket assembly 1. Motor adjustment plate 4 and bearing adjustment plate 6 are secured in position on brush container 2 side plates with brush mounting plate adjustment bolts 18 located in radial slots located concentrically around brush mounting plate pivot pin 17.

Figure 4:
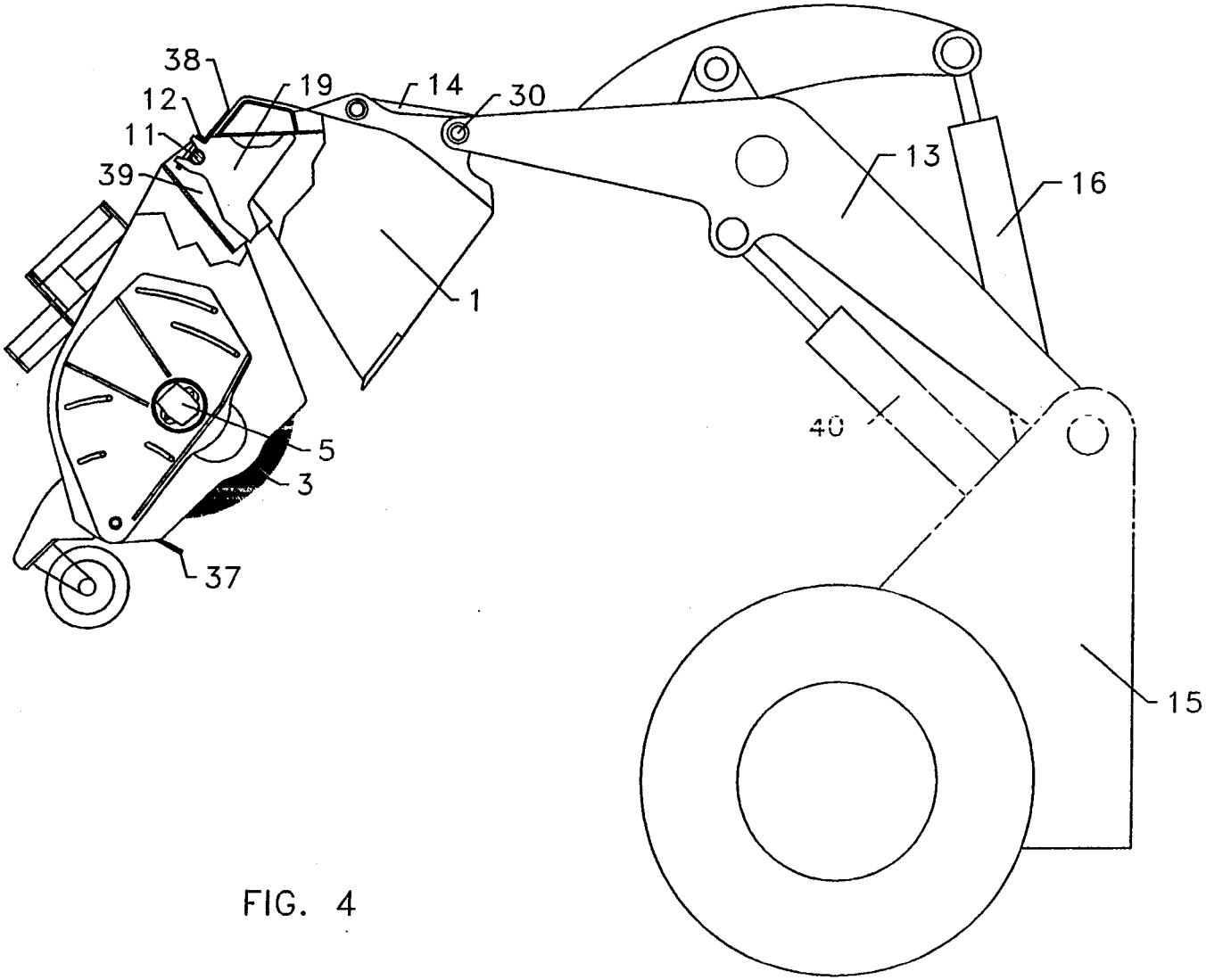
FIG. 4 shows a side view of the brushing apparatus in dumping position.
Figure 5:
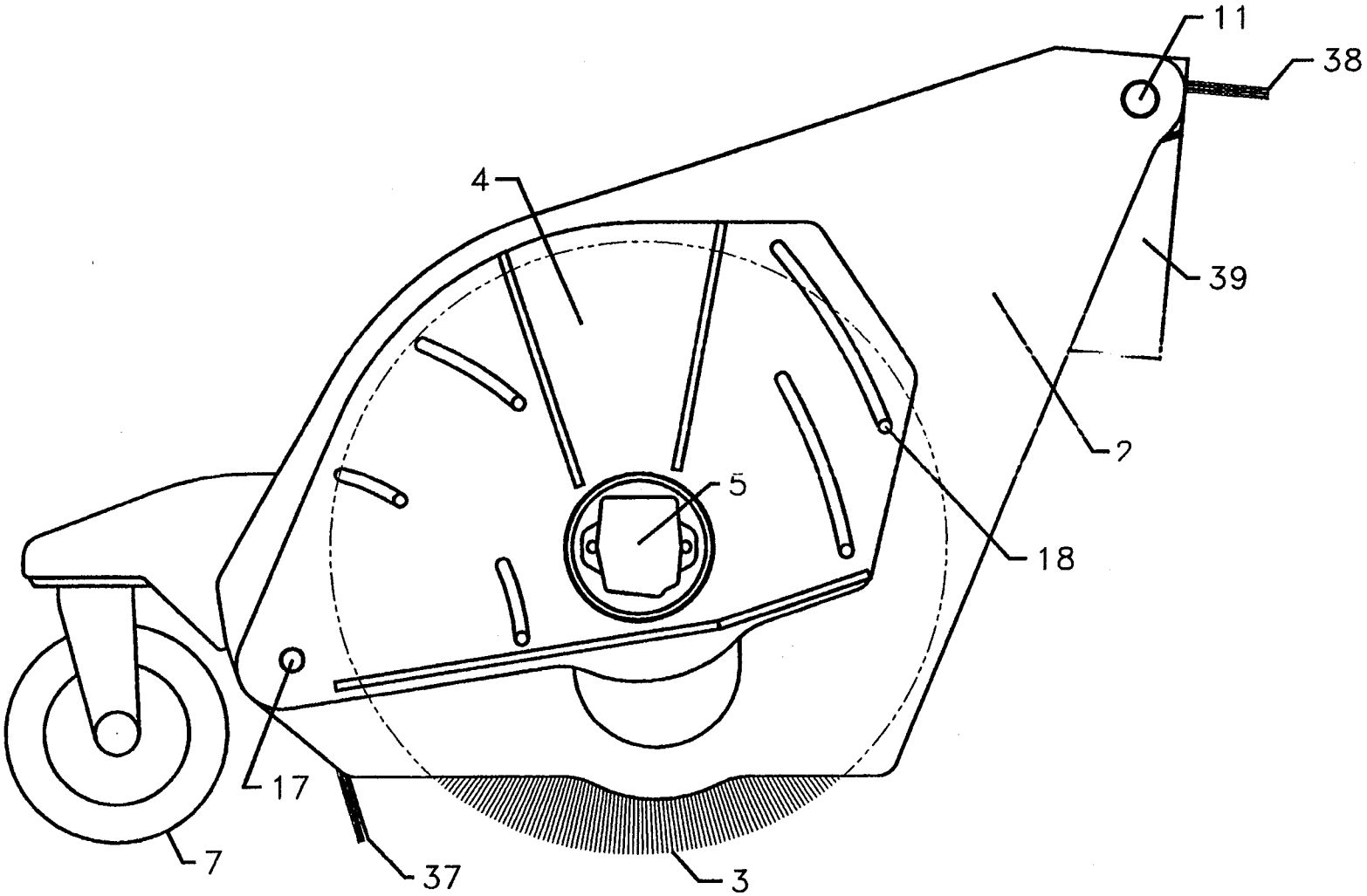
FIG. 5 shows a side view of the power operated brush adjusted to a new brush mounting position.
Figure 6:
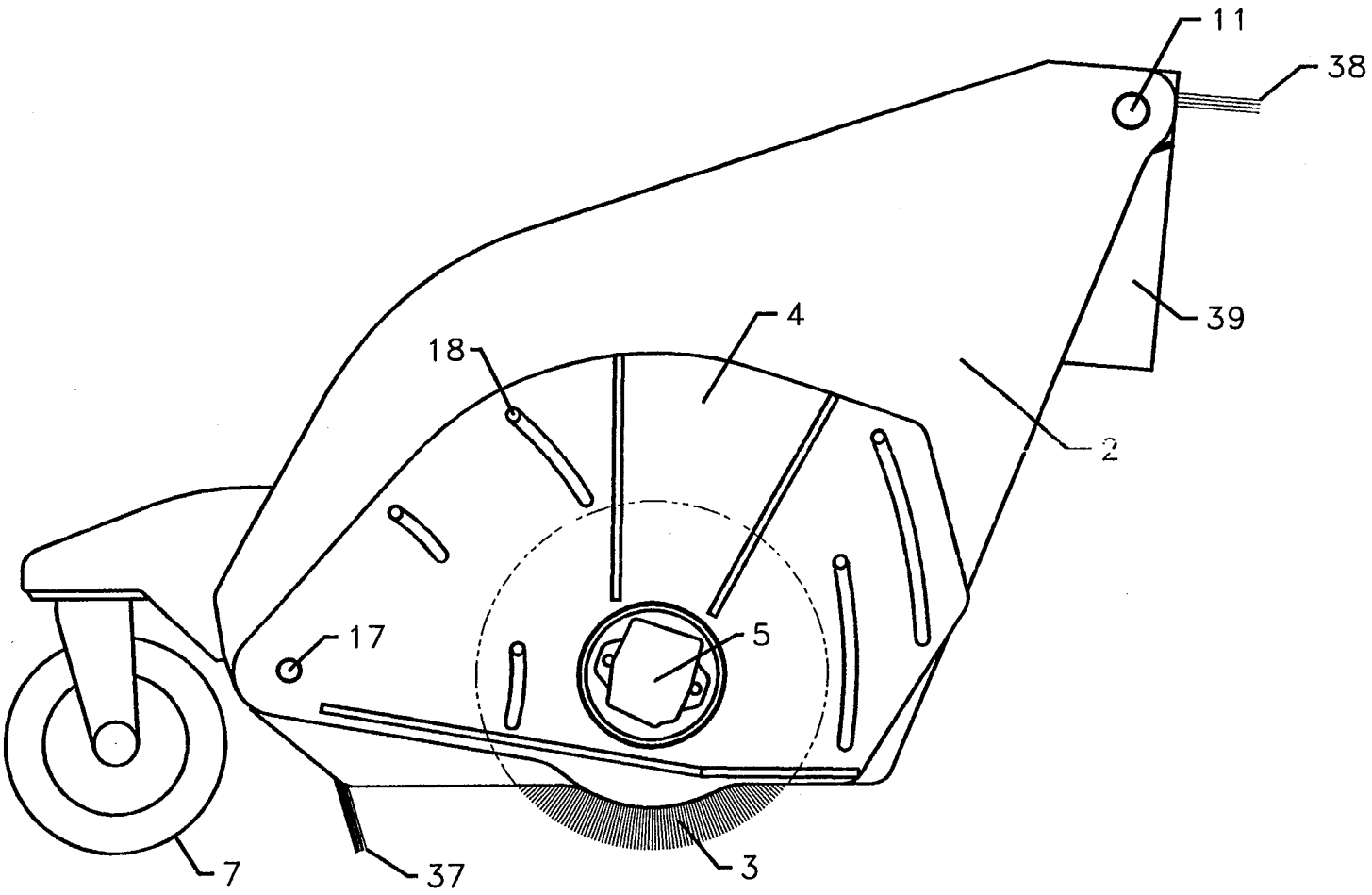
FIG. 6 shows the apparatus shown in FIG. 5 adjusted to a worn brush mounting position.

Motor adjustment plate 4 and beating adjustment plate 6 carry between them, at their lower ends, the brush wafer carrier assembly trunnions 34 that are permanently attached to brush wafer carrier assembly 20 on which brush wafers 3 are fixed. This arrangement provides a brush height adjustment means to compensate for brush wear comprised of motor adjustment plate 4 and bearing adjustment plate 6 pivotally mounted at brush mounting plate pivot pins 17 to a position that best allows contact with the surface to be swept and locked in place with brush mounting plate adjustment bolts 18. The adjustment position for a new brush is shown in FIG. 4 and the position for a worn brush is shown in FIG. 5. Brush wafer carrier assembly 20 can be rotated in a controlled way from the motor vehicle, and in turn, rotates brush wafers 3 fixed on it.

According to the invention, the power operated brush assembly 28 includes rotatable brush wafers 5 supported by bucket assembly 1 to be freely swingable or pivotal relative thereto about brush assembly mounting pin 11 axis.

Figure 2:
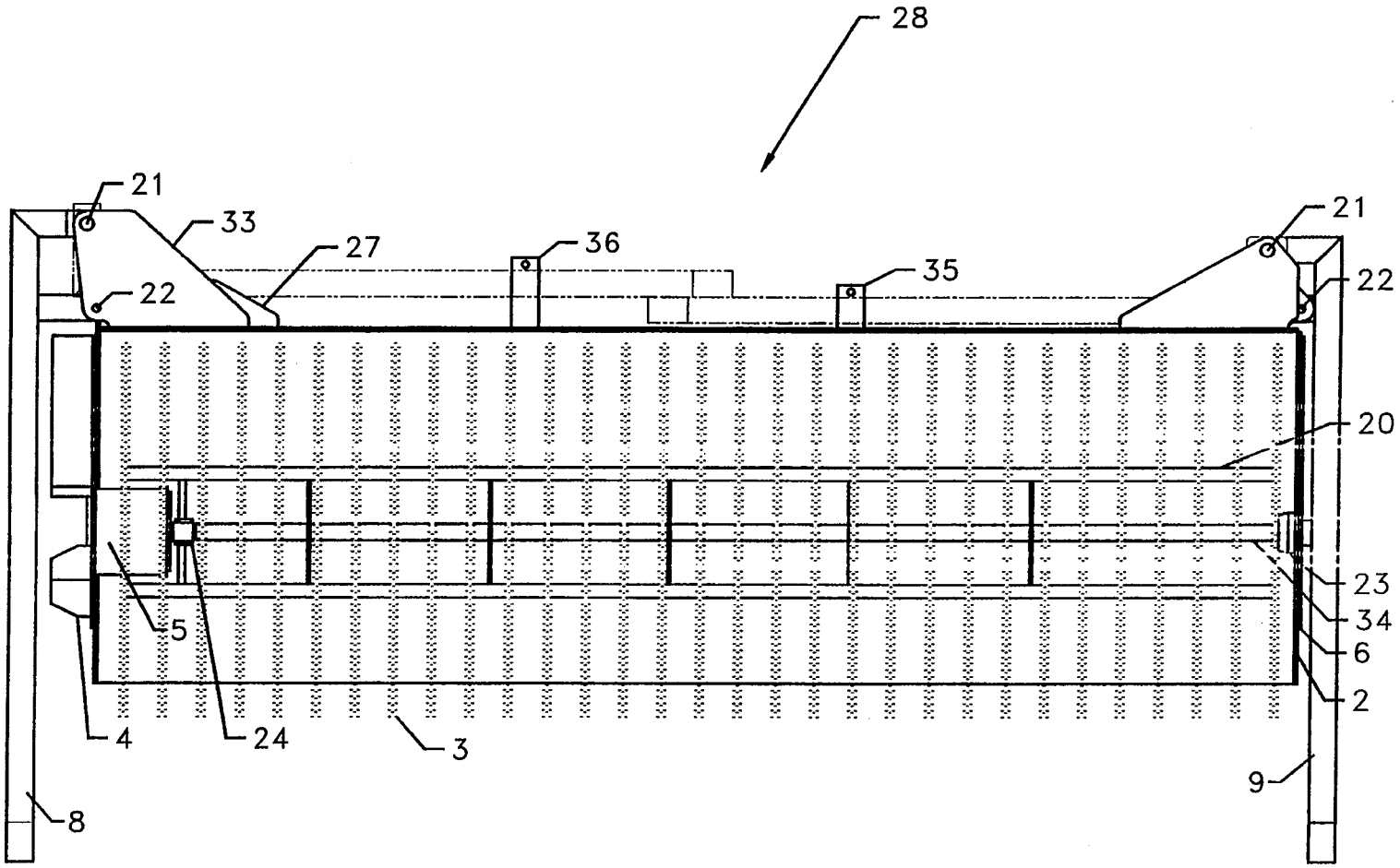
FIG. 2 is a fragmentary detail cross sectional view of the free standing brush assembly, showing the mounting stands of the apparatus shown in FIG. 1.

The means for revolving brush wafer carrier assembly 20 is comprised, as shown in the rear sectional view FIG. 2 of a conventional hydraulic drive motor 5 capable of driving in both directions secured on motor adjustment plate 4. The output shaft of drive motor 5 extends through the side wall of brush container 2 and rotates a brush drive coupling 24 that is secured to one end of brush wafer carrier assembly 20 that also extends through brush support bearing 23 fixed to bearing adjustment plate 6 to rotate brush wafers 3. The hydraulic drive motor 5 is connected to hydraulic hoses connected to a well-known standard three position plunger type valve which in one extreme position permits clockwise rotation of brush wafer carrier assembly 20 and in the opposite extreme position permits counterclockwise rotation. The center position of the valve is usually closed to all ports and uses a well-known cross circuit relief valve to protect against pressure surges when the brush is stopped.

Bucket assembly 1 may be raised or lowered by arm lift cylinders 40 mounted on loader arms 13. The bucket may be tilted with bucket actuation cylinder 16 connected to tipping lever 32 rotating about bucket tipping lever pivot pin 31 and attached to connecting link 14 to give proper alignment of the bucket to the brush assembly and the surface being swept. Lower dust seal 37 located at the lower front edge and upper dust seal 38 located at the top rear edge of power operated brush assembly 28 serve to prevent swept dust from exiting the power operated brush assembly 28 or the bucket assembly 1.

The power operated brushing assembly 28 includes two storable stands, left stand leg 8 and right stand leg 9, mounted to either side of power operated brush assembly 28 and rotatable about stand pivot pin 21 axis attached to front leg stand mounting plate 27 and rear leg stand mounting plate 35 by stand pivot pin 21.

Left stand leg 8 and right stand leg 9 are locked into the lowered position by use of lowered position stand lock pins 22 as viewed in FIG. 2 and are retained in the upper storage position shown in phantom by upper left stand lock 35 and upper right stand lock 36. When the power operated brush assembly 28 is being supported by the lowered stand legs 8 and 9, the brush assembly mounting pin 11 is of a height that will allow the engagement into brush mount bucket hook 19 at the top of bucket assembly 1.

In the brushing position as shown in FIG. 3 the loader arms lie in their down or low position relative to loader front section 15 and the bottom plate of bucket assembly 1 is located nearly flat on the ground by extending or withdrawing the rod from bucket actuation cylinder 16 a suitable distance. The bucket pivot pin 30 axis lies substantially at the bottom of the back plate of bucket assembly 1. Axially aligned brush assembly mounting pins 11 of the power operated brush assembly 28 lie substantially at the top plate of the bucket assembly 1. Axially aligned brush assembly mounting pins 11 of the brush lie above the front plate of bucket assembly 1 substantially in the extension of the plane thereof. In this position the center of gravity of power operated brush assembly 28, and associated components that serve to support brush wafer carrier assembly 20, is so located that the brush undergoes a downward force, caused by gravity, tending to swing the brush about the axis defined by the brush assembly mounting pins 11 in a counter clockwise direction as viewed in FIG. 3 that is, in the direction both of the ground and the front edge of bucket. Thus in the brushing position, the power operated brush assembly 28 driven by the drive motor 5 is automatically swung down towards the direction of the bucket opening. Height control wheels 7 located at the front edge of power operated brush assembly 28 contact the surface to be swept and give the optimum brushing clearance between the surface to be swept and brush wafers 3.

In FIG. 3, if the brush is driven clockwise, the dirt lying on the ground is thrown over the top of brush wafers 3 and into the opening of bucket assembly 1 that fills progressively as the vehicle moves forward. In such a position the front bucket edge 42 may, as shown in FIG. 3, be pressed against the ground, and in such a case it scrapes simultaneously with the brushing operation. The height adjustment of the bucket assembly 1 relative to the ground during a scraping and brushing procedure may be adjusted by raising or lowering bucket assembly 1 by extending or retracting arm lift cylinders 40 to change the position of bucket assembly 1 relative to power operated brush assembly 28 that is supported by height control wheels 7.

After filling, the bucket assembly 1 can be lifted by raising the loader arms 13 by extending or withdrawing the rods of arm lift cylinders 40. Then as shown in FIG. 4, the rods of bucket actuation cylinders 16 may be extended or withdrawn to tilt the bucket assembly 1 downwardly and to pivot the back wall of bucket to an approximately horizontal position, with the axially aligned brush assembly mounting pins 11 lying in front of the bucket assembly 1, that is, in a vertical plane forward of bucket assembly 1. In this position, the center of gravity of power operated brush assembly 28 and associated components that serve to support and rotate the brush wafers 3 are so located that the brush undergoes a force due to gravity that swings the power operated brush assembly 28 slightly clockwise as viewed in FIG. 4 about the brush assembly mounting pins 11. That is, the power operated brush assembly 28 then automatically exposes the bucket opening, which then faces or opens downwardly, and thus, allows discharging of the bucket contents. By driving or revolving the brush in a clockwise direction, the brush serves at the same time as an auxiliary and positive discharge means for bucket assembly 1.

What is claimed is:

1. Brushing apparatus comprising:

a) a motor vehicle provided with a bucket means into which brushed material may be collected, b) a loader arm pivotally attached to the motor vehicle at one end and pivotally attached to said bucket means at the opposite end, c) a means for changing height of the bucket means relative to the motor vehicle, d) a hydraulic cylinder means for rotating the bucket means about the arm attachment pivot, e) a power operated brush assembly including a brush container top and front cover and two side plates, one side plate of which supports a motor mounting adjustment plate and the opposite plate supports a bearing mounting adjustment plate, f) a rotating brush wafer carrier means pivotally supported and driven by a hydraulic motor attached to the motor mounting adjustment plate at one end about a second horizontal axis and pivotally supported by a bearing mounted to the bearing mounting adjustment plate at opposite end, g) a hook and pin mounting means connecting the power operated brush assembly to the bucket means about a third horizontal axis at the upper front edge of the bucket means which supports the power operated brush assembly and permits said brush assembly to swing freely relative to the bucket means under the action of gravity when the said tool holder is rotated about the boom attachment pivot and h) a stand means comprising left and right stand legs pivotally attached to stand mounting plates fixed to the power operated brush assembly to support the power operated brush assembly whereby the brush assembly may be disconnected from the bucket means and allow the power operated brush assembly to be free standing when not in use.

2. Brushing apparatus as claimed in claim 1, wherein a brush height adjustment means comprises said motor adjustment plate and said bearing adjustment plate pivotally attached to a brush mounting plate pivot pin which is horizontally fixed to either brush container side plate and a series of brush mounting plate adjustment bolts acting in radial slots concentrically located about the mounting plate pivot pin in both the motor adjustment plate and the bearing adjustment plate to either brush container side plate whereby the height of the brush wafer carrier assembly may be varied relative to the ground by rotating the motor adjustment plate and bearing adjustment plate about the axis of the mounting plate pivot pin and locking said plates into place with the brush mounting plate adjustment bolts.

3. Brushing apparatus as claimed in claim 1 wherein the left stand leg and right stand leg are locked into a lowered position by use of lowered position stand lock pins and are retained in an upper storage position by upper left stand lock means and upper right stand lock means, and when the power operated brush assembly is being supported by the lowered stand legs, the brush assembly mounting pin is of a height that will allow the engagement into said brush assembly mounting hook at the top of said bucket means.

* * * * *